US010231545B2

(12) United States Patent
Moreschi

(10) Patent No.: US 10,231,545 B2
(45) Date of Patent: Mar. 19, 2019

(54) OSCILLATION MECHANISM FOR CHAIRS

(71) Applicant: CO.FE.MO. INDUSTRIE S.R.L., Castegnato (IT)

(72) Inventor: Sergio Moreschi, Castegnato (IT)

(73) Assignee: CO.FE.MO. INDUSTRIE S.R.L., Castegnato (IT)

( * ) Notice: Subject to any disclaimer, the term of this patent is extended or adjusted under 35 U.S.C. 154(b) by 0 days.

(21) Appl. No.: 15/765,976

(22) PCT Filed: Oct. 11, 2016

(86) PCT No.: PCT/IB2016/056079
§ 371 (c)(1),
(2) Date: Apr. 4, 2018

(87) PCT Pub. No.: WO2017/064619
PCT Pub. Date: Apr. 20, 2017

(65) Prior Publication Data

US 2018/0279785 A1 Oct. 4, 2018

(30) Foreign Application Priority Data

Oct. 15, 2015 (IT) ..... UB2015A4688

(51) Int. Cl.
*A47C 3/026* (2006.01)
*A47C 1/032* (2006.01)
(Continued)

(52) U.S. Cl.
CPC ..... *A47C 1/03266* (2013.01); *A47C 1/03272* (2013.01); *A47C 3/026* (2013.01);
(Continued)

(58) Field of Classification Search
CPC . A47C 1/03266; A47C 1/03272; A47C 7/441; A47C 7/443; A47C 3/0255; A47C 3/026
(Continued)

(56) References Cited

U.S. PATENT DOCUMENTS 4,948,198 A * 8/1990 Crossman ..... A47C 3/026 297/302.4
5,108,065 A * 4/1992 Puerner ..... A47C 3/0255 248/188.1

(Continued)

FOREIGN PATENT DOCUMENTS

EP 1 258 212 A2 11/2002
WO 2010/103554 A1 9/2010
WO WO-2016166728 A1 * 10/2016 ..... A47C 3/025

OTHER PUBLICATIONS

International Search Report and Written Opinion of the International Searching Authority for International Patent Application No. PCT/IB2016/056079 dated Jan. 4, 2017, 8 pages.

*Primary Examiner* — Rodney B White
(74) *Attorney, Agent, or Firm* — Merchant & Gould P.C.

(57) ABSTRACT

An oscillation mechanism for chairs includes a support frame, a structure coupled to the support frame to rotate about a first axis, an elastic element interposed between the support frame and the structure and configured to oppose a reaction force to an oscillation of the structure. The reaction force generates a reaction moment acting on the structure with respect to the first axis. An oscillation adjustment system is able to vary the reaction moment with the oscillation being unchanged. The adjustment system includes a pin movably coupled to the structure and a movement system of the pin for varying the distance between the pin and the first axis. The elastic element is directly fastened to the pin so that the reaction force is transmitted to the structure with the application point corresponding to the pin and with direction and orientation unchanged.

10 Claims, 11 Drawing Sheets

(51) Int. Cl.
*A47C 3/025* (2006.01)
*A47C 7/44* (2006.01)

(52) U.S. Cl.
CPC ..... *A47C 3/0255* (2013.01); *A47C 7/441* (2013.01); *A47C 7/443* (2013.01)

(58) Field of Classification Search
USPC ..... 297/300.1–303.5
See application file for complete search history.

(56) References Cited

U.S. PATENT DOCUMENTS 5,224,758 A * 7/1993 Takamatsu ..... A47C 3/026 297/300.5
5,263,677 A * 11/1993 Puerner ..... A47C 3/0255 248/370
6,033,020 A * 3/2000 Ito ..... A47C 1/026 297/302.4
6,120,096 A * 9/2000 Miotto ..... A47C 1/03255 297/300.1
6,382,724 B1 * 5/2002 Piretti ..... A47C 1/03255 297/302.3
6,929,327 B2 * 8/2005 Piretti ..... A47C 1/03255 297/300.2
8,439,442 B2 * 5/2013 Highlander ..... A47C 7/14 297/302.7
2001/0013569 A1 * 8/2001 Donati ..... A47C 1/03255 248/372.1
2001/0050500 A1 * 12/2001 Piretti ..... A47C 1/03238 297/300.2
2003/0001417 A1 * 1/2003 Moreschi ..... A47C 1/03238 297/300.5
2007/0040432 A1 * 2/2007 Donati ..... A47C 3/026 297/300.2
2011/0127820 A1 * 6/2011 Moreschi ..... A47C 1/03255 297/354.1
2014/0014806 A1 * 1/2014 Yamamoto ..... F16M 13/00 248/550

* cited by examiner

OSCILLATION MECHANISM FOR CHAIRS

This application is a National Stage Application of PCT/IB2016/056079, filed 11 Oct. 2016, which claims benefit of Serial No. UB2015A004688, filed 15 Oct. 2015 in Italy and which applications are incorporated herein by reference. To the extent appropriate, a claim of priority is made to each of the above-disclosed applications.

BACKGROUND OF THE INVENTION

The present invention relates to an oscillation mechanism for chairs comprising an adjustment system of the oscillation of a structure of a chair, which allows to change the intensity of the reaction that the system opposes to a given oscillation exerted by the user.

Chairs are known, in particular for office, which comprises a support frame coupled to floor prop means, and at least one oscillating structure with respect to the support frame. This structure can be, for example, the seat support and/or the backrest support of the chair. In some embodiments, the seat support and the backrest support are rigidly coupled between themselves and oscillate as one, in others embodiments the seat support and the backrest support are both oscillating with respect to the frame in an independent way or in a way reciprocally coupled but not rigidly.

When the oscillating structure oscillates under the thrust of the user, the chair opposes an elastic reaction which tends to bring back the chair in its rest position (without thrust). This reaction is typically realized by an elastic element, for example a spring.

Adjustment systems of the oscillation are also known, which can adjust, according to the user's preferences, the intensity of the reaction torque which the chair opposes to a given oscillation, and which has to be balanced by the user.

The Applicant has nonetheless discovered that some known adjustment systems are not efficient in transferring the forces involved and/or are not adjustable comfortably by the user.

According to the Applicant some known adjustment systems are structurally complex and/or complex to be used, and/or bulky and/or heavy and/or expensive to be produced.

For example, the Applicant has considered that known adjustment systems can show a size and/or a weight and/or a cost such that they cannot be used in those applications for which the chair has to comply size and/or weight and/or cost limits.

The Applicant has also perceived the problem of preventing that the actuation member of the adjustment must undergo a very wide excursion to bring the chair from a configuration of maximum stiffness to a configuration of maximum softness of the chair reaction. In fact, said wide excursion can create discomfort to the user.

SUMMARY OF THE INVENTION

A purpose of the present invention is to develop an adjustment system of the oscillation for chairs able to change the intensity of the reaction which the system itself opposes to a given oscillation exerted by the user, which solves one or more of the problems described above.

A purpose of the present invention is to develop an adjustment system of the oscillation for chairs able to change the intensity of the reaction which the system itself opposes to a given oscillation exerted by the user, which is compact and/or structurally simple such as it can be integrated in chairs which have to comply to tight requirements of cost and/or weight and/or size.

Furthermore, the adjustment system of the present invention is able to change the intensity of the reaction in a broad range of variability, with a corresponding limited excursion of the actuation lever.

One or more of these purposes are accomplished by an adjustment system of the oscillation for chairs according to the attached claims and/or having the following features.

In a first aspect the invention concerns an oscillation mechanism for chairs comprising a support frame suitable to be mounted on a stem of a chair, a structure pivotally coupled to said support frame so as to rotate about a first axis, and an elastic element interposed between said support frame and said structure and configured to oppose a reaction force to an oscillation of said structure about said first axis from a rest position, in the absence of oscillation forces, to an oscillation position, said reaction force generating a reaction moment acting on said structure with respect to the first axis.

The oscillation mechanism comprises an oscillation adjustment system able to vary said reaction moment with said oscillation being unchanged.

Preferably the adjustment system comprises a pin movably coupled to said structure so as to be able to vary the distance between the pin and the first axis, where said elastic element is directly fastened to said pin so that said reaction force is transmitted to said structure with the application point corresponding to said pin and with direction and orientation unchanged.

'Elastic element directly fastened to said pin' means that the reaction force exerted by the elastic element itself when the structure is oscillated from a rest position, is transmitted to the structure with a point of application coincident with the pin position and with the same direction and orientation.

Preferably there are no further elements interposed between the elastic element and the pin.

Preferably said reaction force transmitted to said structure is directed according to a main development direction of said elastic element.

According the Applicant, the aforementioned adjustment system, because the elastic reaction element applies its reaction force directly on the pin which in turn transmits the force unchanged to the structure, makes possible to change the arm of said reaction force with respect to the first rotation axis, and thus the reaction torque generated by said reaction force on said structure, moving the point of application (which is on the pin) of the reaction force onto the structure, keeping at the same time the number of the elements which constitute the mechanism limited and simplifying the whole structure of the mechanism (and so the production cost and/or the size). For example, the aforementioned solution realizes a particularly short transmission chain of the reaction force from the elastic element to the oscillating structure, for example comprising only the pin, without need of further elements along that transmission chain (these elements would need appropriate sizing for guaranteeing the needed toughness).

Furthermore, according to the Applicant, the adjustment system of the present invention allows to obtain a wide variation of the intensity of the reaction by the mechanism in the face of a limited excursion of the actuation member of the system. For example, in some embodiments few turns of the actuation lever are sufficient, or even less than a turn, or even less than half a turn.

Preferably said pin has an extension parallel to said first axis.

Preferably the adjustment system comprises a movement system of said pin for varying said distance between said pin and said first axis.

Preferably said movement system comprises a guide integral with said structure and a movement member slidably engaged in said guide, where the movement member engages said pin in such a way that when the movement member slides in said guide, the movement member moves said pin. In this way it is obtained the sliding movement of the pin of the movement member with respect to the structure, with advantages in terms of structural simplicity and/or functionality.

Preferably said guide has a curvilinear extension, more preferably along a first arc of circle with a concavity directed towards said movement member (and/or towards said pin), even more preferably lying in a plane orthogonal to said first axis.

Preferably said movement member has at least a first slot, preferably a pair of first slots specularly opposed (preferably obtained from a wall of said member or, respectively, from two opposed walls of said member) and crossed by said pin transversally (typically orthogonally) to a (respective) plane of the main development of the first slot(s), said movement member being configured to move said pin along a respective main development line of the first slot(s) in correspondence with the slide in said guide. In this way it is obtained the sliding movement of the pin of the movement member with respect to the structure, with advantages in terms of structural simplicity and/or functionality.

Preferably said first slot(s) is/are shaped and/or oriented in said respective main development plane, in such a way that inner surfaces of the first slot(s), when the movement member slides in the guide, exert a thrust on the pin forcing it to move along the first slot(s). This contributes to obtain the aforementioned advantage of a limited excursion of the actuation member. The particular shape and/or orientation depends on many factors as better explained in the following. In an embodiment said main development line is (almost) a circle arc.

Preferably a section of each first slot on said (respective) main development plane and/or at least one contact surface between said guide and said movement member is/are toothed along the respective main development line. In this way, the position of the pin is discrete, also giving a return signal to the user during the adjustment of the position.

Preferably said section of each first slot is composed of a discrete series of seats for housing the pin, each seat being separated from the nearby seat(s) by a projection. In this way, the system can be designed such as, during the oscillation, a possible component of said reaction force thrusting on the pin towards said movement member (which can make the pin slid undesirably along the first slot(s)), remains inside of the projections of the seat in which the pin is located, avoiding the aforementioned undesired slide. So, the movement member is thrusted by a force that keep it against the guide, and locked in the respective position.

Preferably at least a portion of the inner surface of each first slot is elastically deformable. In this way the pin can overcome easily the projections during the adjustment of the position of the pin.

Preferably said movement system comprises a guide body in which said guide is formed, the guide body being rigidly connected to said structure, preferably in correspondence with an upper wall of said structure. In this way, the overall size is optimized.

Preferably the movement member has an engagement portion counter-shaped to said guide.

Preferably said movement system comprises an actuation lever rotationally fixed to said structure so as to rotate around a second axis (preferably parallel to said first axis and typically integral with said structure) and connected to said movement member by a junction, having a third axis (preferably parallel to said first axis and/or second axis). In this way it is conveniently possible making the movement member slide along the guide by the rotation of the actuation lever.

Preferably said junction comprises a cylinder rigidly connected to one between said movement member and said actuation lever and a second slot formed in the other between said movement member and said actuation lever, the slot having preferably radial extension with respect to the third axis (such as to allow, by the movement of the cylinder inside the slot, the recovery of the relative displacement between the member and the lever during the actuation of the member by the lever).

Preferably said movement system comprises an actuation stem rigidly coupled to said actuation lever and having main extension along said second axis (such as to allow the user to easily operate the actuation lever).

Preferably the adjustment system is integral with said structure during the oscillation. In fact, during the oscillation the pin is kept locked in the slot of the structure.

Preferably the movement member and/or the guide body and/or the actuation lever are made of plastic material. This also because such elements do not contribute in a substantial way to the transmission chain of the reaction force.

Typically, the elastic element has a main expansion direction coinciding with the direction of the reaction force.

Typically said elastic element has a first end rotationally fixed to the support frame to be able to rotate around a fourth axis (typically orthogonal to said reaction force and/or parallel to said first and/or second and/or third axis) and a second end longitudinally opposite to the first end and fastened (for example rotationally) to said pin (which typically is orthogonal to said reaction force and parallel to said forth axis). In this way the elastic element can suitably orient itself during the adjustment of the position of the pin and/or during the oscillation of the structure.

Typically said frame has a bottom wall and said elastic element (more preferably said fourth axis) is in correspondence of said bottom wall. In this way, the second end of the elastic element tends naturally downwards under action by the gravity force.

Said elastic element can comprise a spring, interposed longitudinally between its two ends, preferably a traction spring.

Preferably when the structure is in said rest position, said elastic element has no elastic energy (in other terms it is in the undeformed configuration and does not generate any elastic recovery force). In this way it is possible to adjust the position of the pin, in the rest position, without contrasting any elastic recovery force generated by the elastic element.

In an embodiment, the mechanism can comprise a further elastic element interposed between said support frame and said structure and configured for opposing a further reaction force to said oscillation of said structure about said first axis. Preferably said further elastic element is structurally identical to said elastic element. Preferably said further elastic element has a first end rotationally fixed to the support frame for rotating around a respective rotation axis (typically parallel to, or coincident with, said fourth axis) and a second end longitudinally opposed to the first fixed (for example rotationally) to a further pin (typically orthogonal to the further reaction force and parallel to said pin), the further pin being coupled to said structure so that said further reaction force is transmitted to said structure with point of application corresponding with said further pin and with direction and orientation unchanged. To this purpose, for example the further pin engages a couple of opposite holes of the structure. Preferably said further pin is coupled to said structure in a fixed position.

Preferably in rest position the further elastic element develops a residual elastic force (for example it is slightly in traction) and said structure is kept against the support frame by said residual elastic force. In this way, advantageously at rest position the structure is kept against the structure (until the application of an oscillation force sufficiently intense to counteract the residual reaction force) by the further elastic element, while said elastic element is totally not tensioned, so allowing an easy movement of the pin.

Preferably the adjustment system has at least a second slot, preferably a couple of second slots specularly opposite, obtained on said structure (preferably on a wall of said structure or respectively on two opposite walls of said structure) and crossed by said pin transversely (typically orthogonally) to a respective main development plane of the second slot, said movement system being configured to move said pin also along a main development line of the second slot. In this way advantageously the pin can move with respect to the first axis keeping a mechanical coupling with structure.

Preferably said main development line of the second slot(s) has a curvilinear shape in a plane orthogonal to said fourth axis, more preferably has a development along a second arc of a circle having its center on said fourth axis and a radius equal to a distance between said pin and said fourth axis in the rest position. In this way, the length of the elastic element is not changed during the adjustment of the position of the pin, so avoiding the presence of elastic forces which would counteract the adjustment of the oscillation.

According a further aspect, the present invention concerns a chair comprising the oscillation mechanism having one or more of the aforementioned features.

Preferably the chair comprises floor prop means, which comprises for example a stem, said support frame being rigidly mounted on said stem. The chair comprises preferably a seat for a user and/or a backrest. Said structure can be for example integral with the seat and/or the backrest.

BRIEF DESCRIPTION OF THE DRAWINGS

The features and the advantages of the present invention will be further explained in the following detailed description of some embodiments, showed as an example and not restrictive of the present invention. The following detailed description refers to the attached figures, in which.

Figure 1:
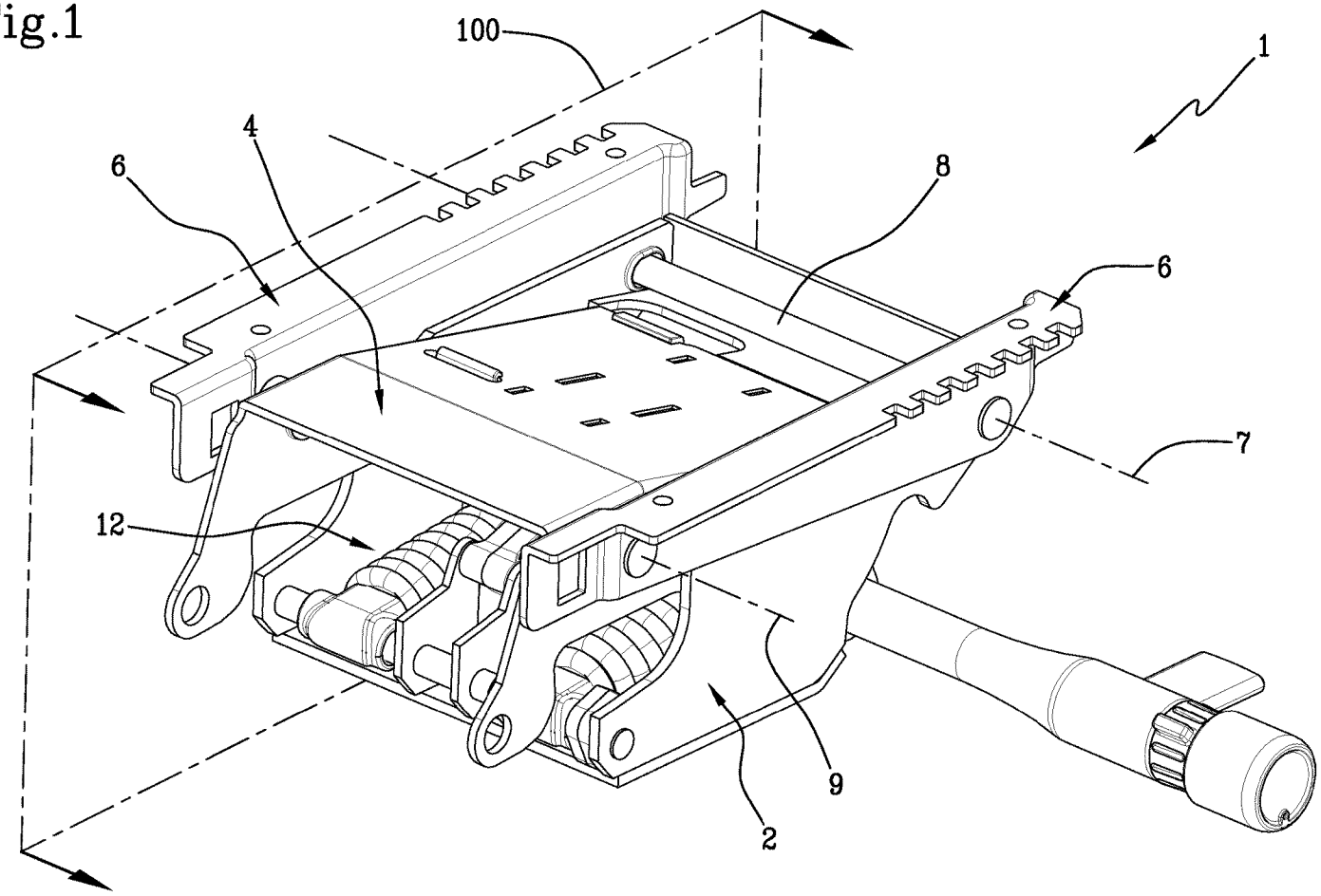
FIG. 1 is a perspective view of an exemplar embodiment of the adjustable oscillation mechanism of the present invention.
Figure 2:
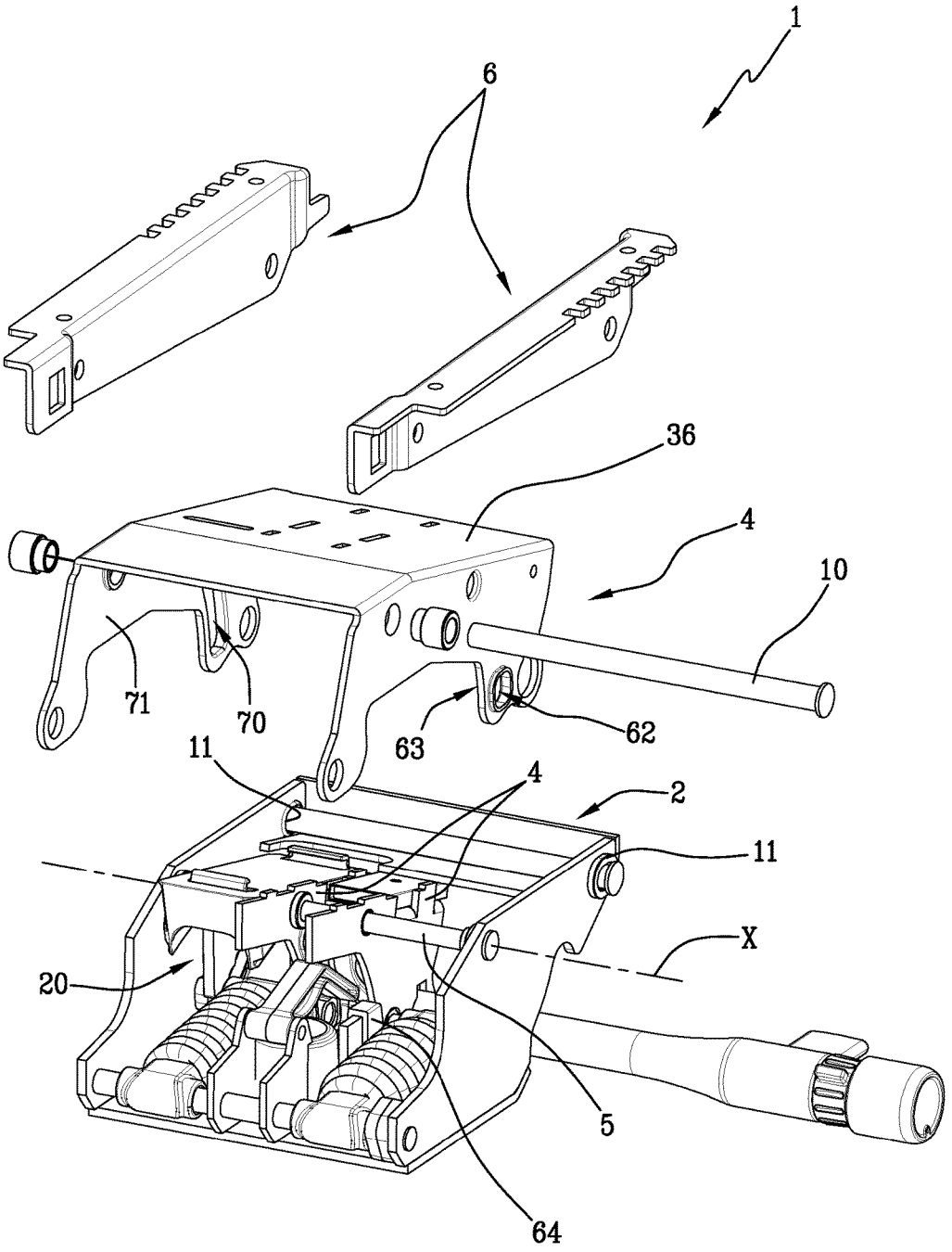
FIGS. 2-5 show the embodiment of FIG. 1 with some parts progressively removed and/or exploded.
Figure 3:
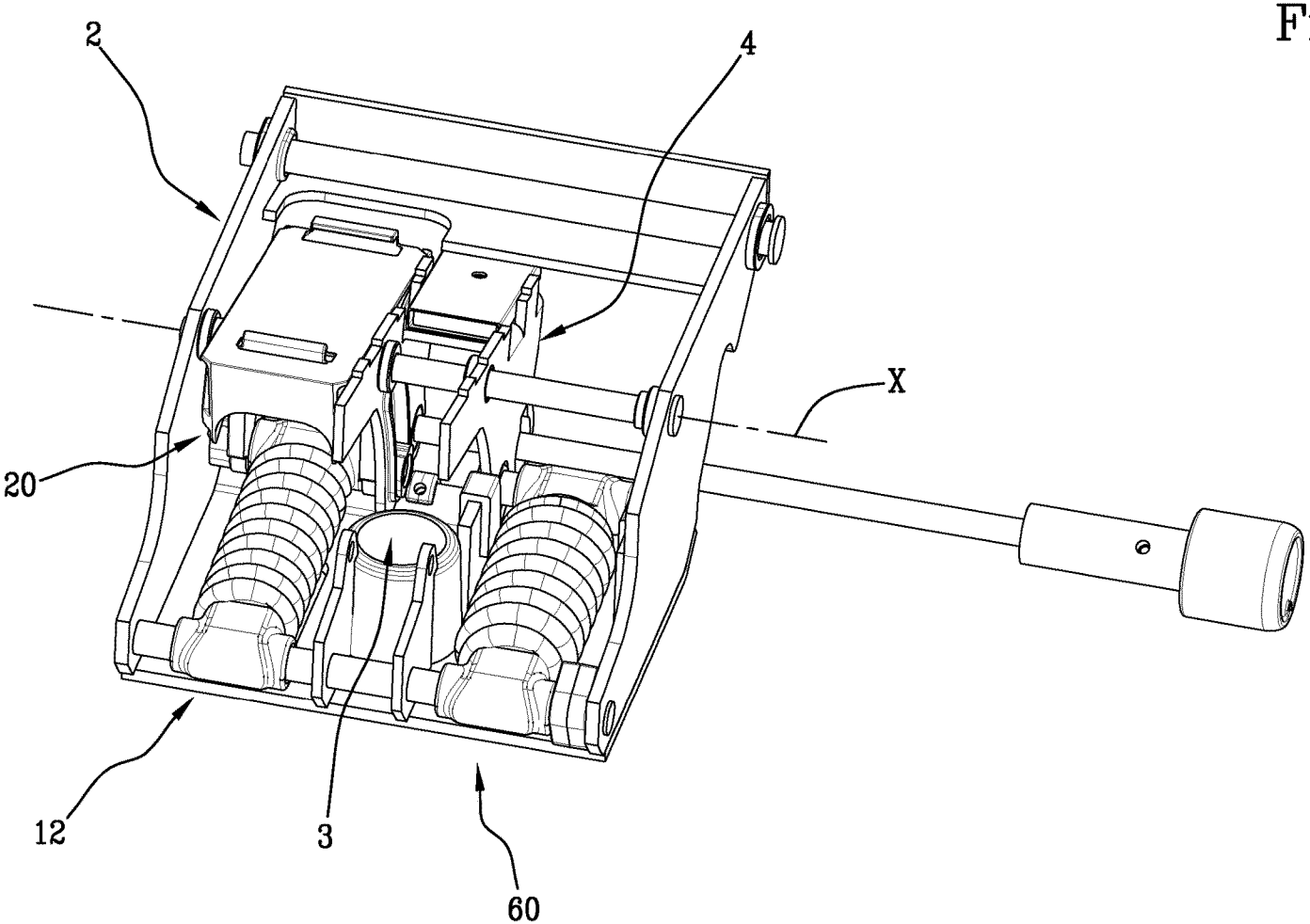
Figure 4:
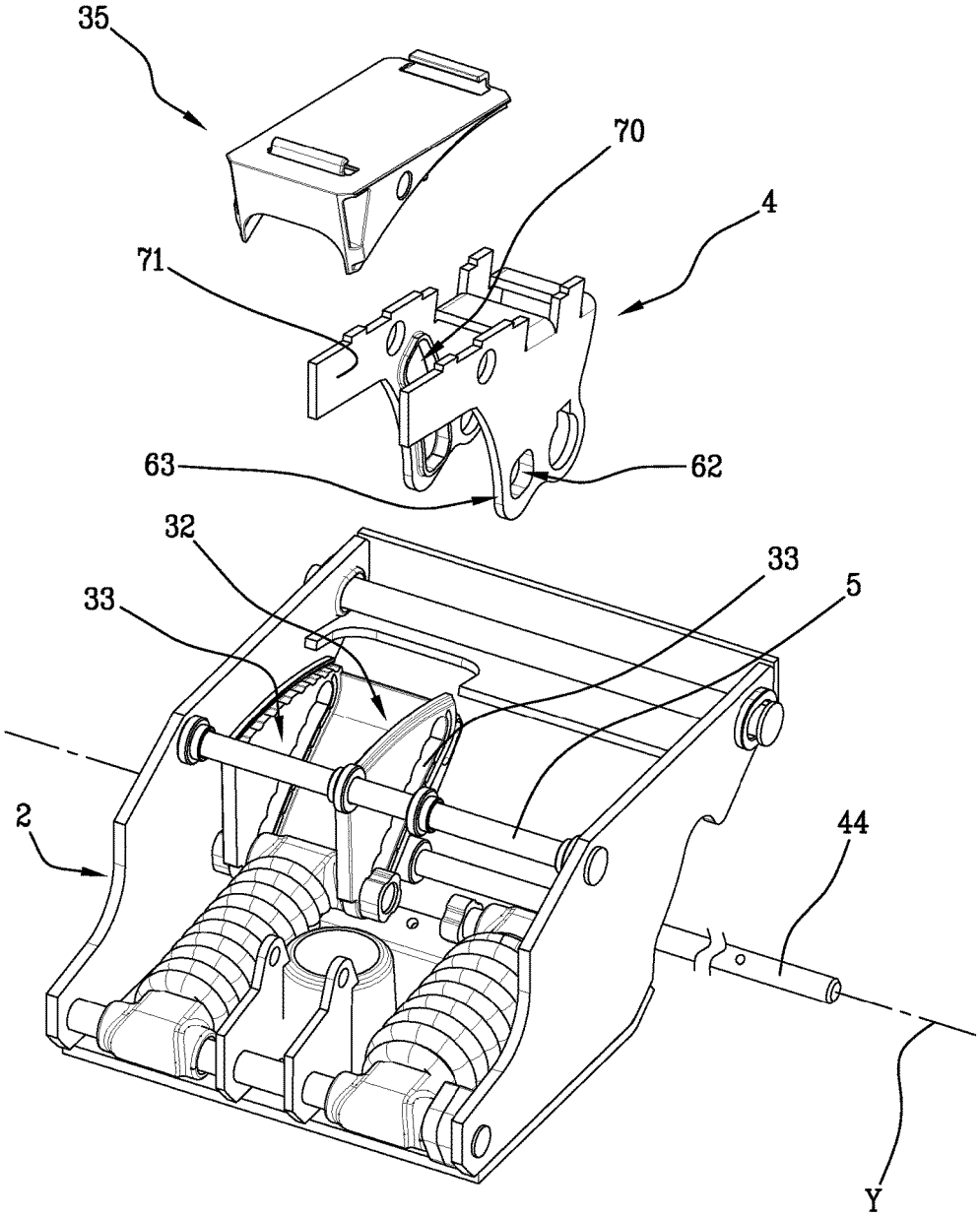
Figure 5:
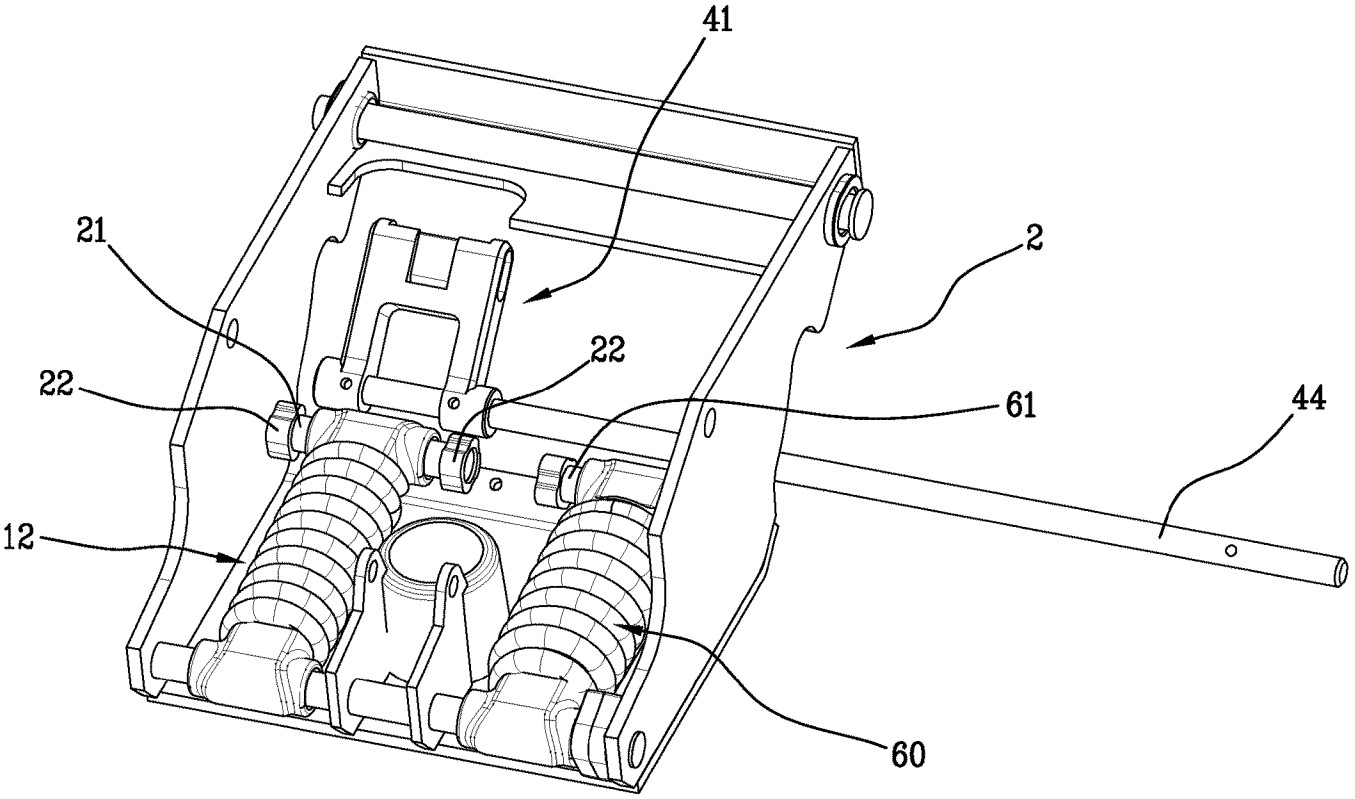
Figure 6A:
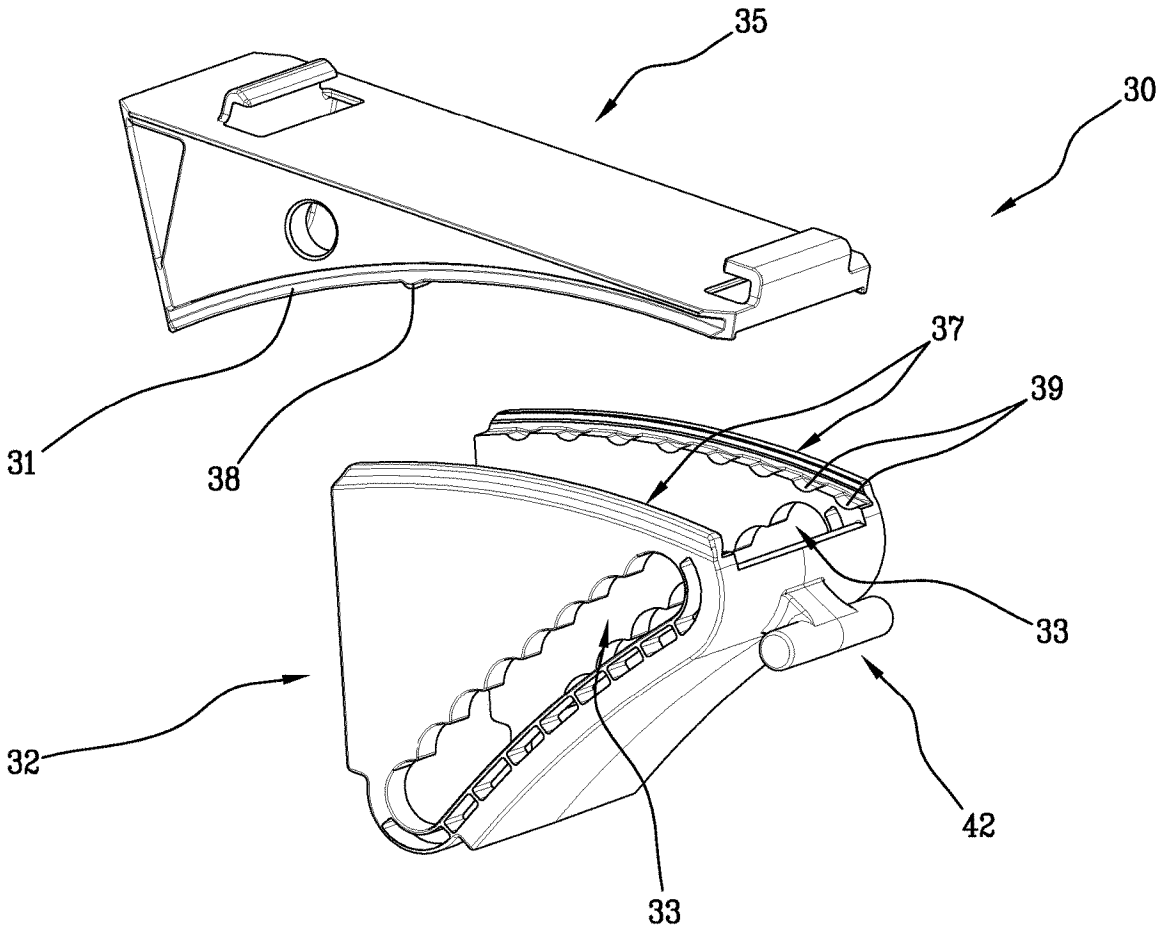
FIGS. 6A-6B show two exploded views, respectively from two different angles, of a detail of the mechanism of FIG. 1.
Figure 6B:
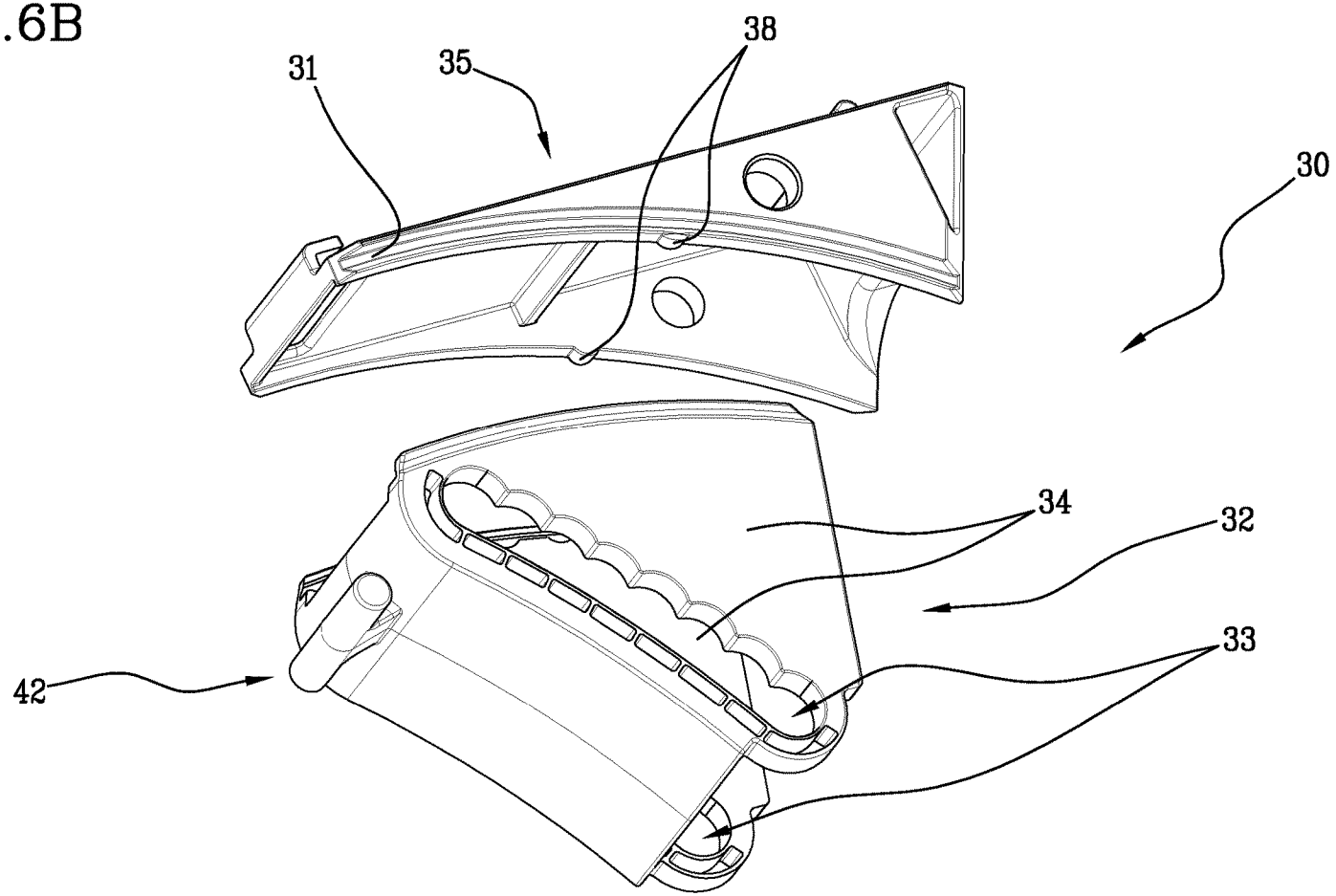
Figure 7:
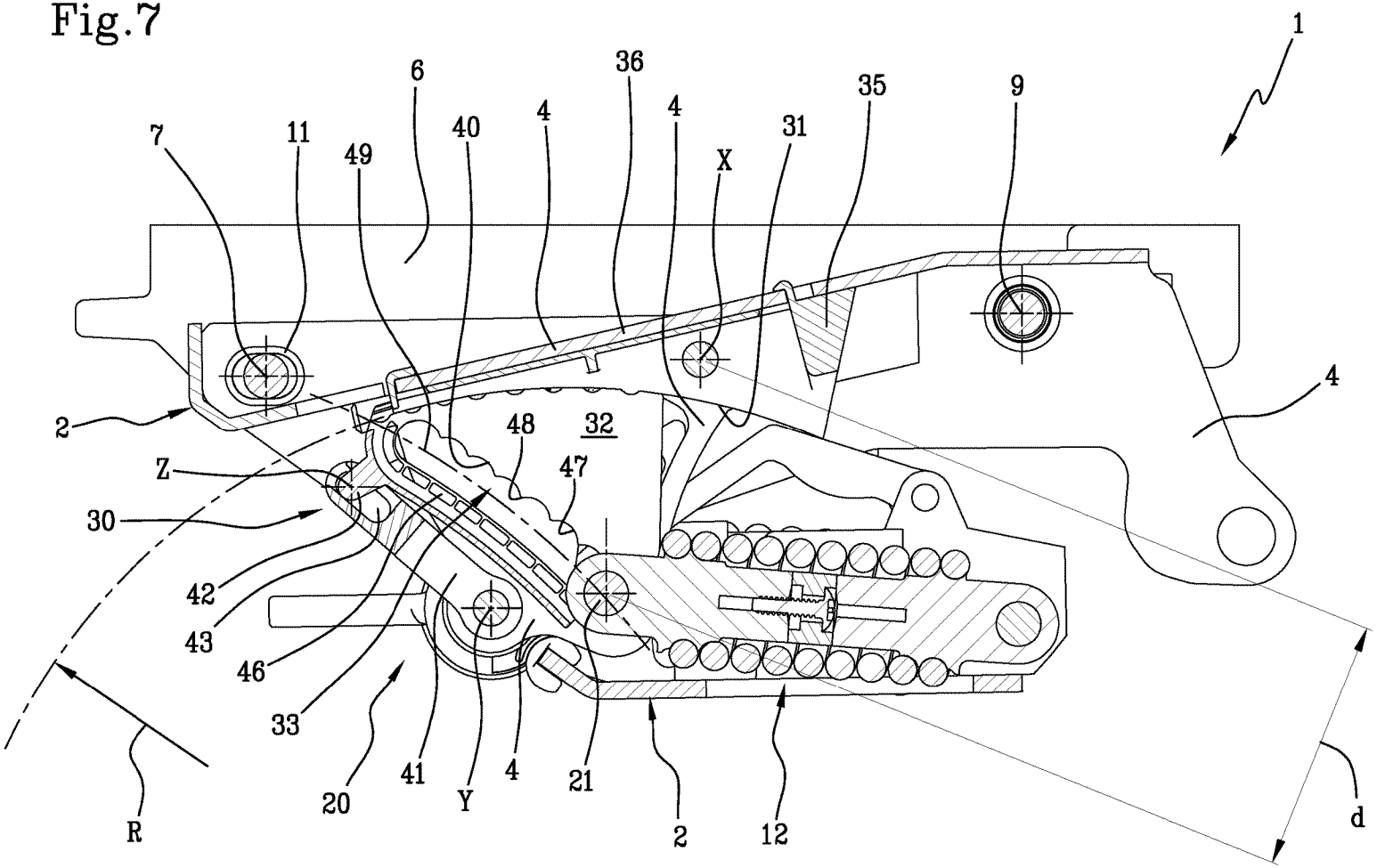
FIG. 7 is a longitudinal section of the embodiment of FIG. 1 along the section plane 100, in an own first configuration and at rest position.

In the figures, it is shown an oscillation mechanism 1 for chair according to a possible embodiment of the present invention.

DETAIL DESCRIPTION OF THE PREFERRED EMBODIMENT

In FIGS. 1-7 the mechanism is shown at rest condition (absence of oscillation forces) and in a first configuration corresponding to an adjustment of maximum stiffness, as better explained in the following.

The oscillation mechanism 1 comprises a support frame 2, which is intended to be coupled to floor prop means (not shown) of a chair. For example, a stem can engage a cavity 3 of the support frame, to which are associated adjustment mechanisms of the position (height) of the frame along the stem, not further descripted because for example of known type.

The oscillation mechanism comprises a structure 4 rotationally coupled to the support frame such as it can rotate about a first axis X, preferably integral with the frame. For example, a pin 5, coaxial to the first axis X, is mounted on the frame (e.g. by means of appropriate bushings) and passes through (along appropriate through holes) the structure 4 (and all the elements that are on its way) for the entire width.

In the example shown the structure is a support for a backrest (not shown) of the chair. In this example the mechanism 1 comprises also a support 6 of a seat (not shown) of the chair, in form of a couple of wings. The support 6 of the seat is rotationally coupled to the support frame so as it can rotate about a respective axis 7. For example, a pin 8, coaxial with axis 7, is mounted on the frame (e.g. by means of appropriate bushings 11) and passes through the support 6. In the example shown the support 4 of the backrest and the support 6 of the seat are mutually articulated so as to oscillate synchronously. To this aim the support 6 of the seat is rotationally coupled also to the structure 4, or backrest support, such as it can rotate about a respective axis 9. For example, a pin 10, coaxial to axis 9, is mounted on the support 6 (e.g. by means of appropriate bushings) and pass through the support 4 of the backrest. For the purpose of allowing the articulation between the seat support 6 and the backrest support 4, the bushings 11 of the pin 8 of the seat support are slotted.

Nevertheless, the present invention comprises also mechanisms (not shown) in which the structure 4 is a seat support, or in which the seat support and the backrest support are mutually rigidly coupled and oscillates in unison, or in which the seat support and the backrest support are both oscillating with respect to the support frame in an independent way.

The mechanism 1 comprises an elastic element 12 interposed between said support frame 2 and said structure 4 and configured for counteracting a reaction force to an oscillation of said structure about said first axis X from a rest position (shown for example in FIGS. 1-8), in absence of oscillation forces, to an oscillation position (shown for example in FIGS. 9-10), the reaction force generating a reaction torque acting on the structure about the first axis X.

The oscillation mechanism 1 comprises an adjustment system 20 of the oscillation able to vary said reaction torque with said oscillation being unchanged.

The adjustment system preferably comprises a pin 21 movably coupled (e.g. by means of appropriate bushings 22) to said structure 4 such as it can be varied the distance between the pin 21 and the first axis X, wherein the elastic element is directly fastened to the pin so that the reaction force is transferred to the structure with a point of application corresponding with the pin and with direction and orientation unchanged (namely typically the force thrusting on the structure is directed along the main extension direction 50 of the elastic element 12). In the shown example, the pin 21 is a single cylindrical piece, however in others embodiments it can be composed by a plurality of distinct pieces (for example two axially aligned pins) and/or it can have conformation different from cylindrical, provided that it realizes a coupling between the elastic element and the structure sufficiently articulated to allow the reciprocal movement and furthermore so that the force of the elastic element is transferred on the structure without changing direction of the force.

Preferably there are no further elements interposed between the elastic element and the pin and between the pin (including its bushings 22) and the structure 4.

Advantageously the adjustment system 20 comprises a movement system 30 of the pin for varying the distance between the pin and the first axis. Preferably the movement system comprises a guide 31 integral with the structure 4 and a movement member 32 slidably engaged in the guide, wherein said movement member engages the pin 21 such as, when the movement member slides along to the guide, the movement member moves the pin 21.

Preferably the guide 31 has a curvilinear development, more preferably along a first circle arc with concavity oriented towards the movement member and towards the pin 21, and lying in a plane orthogonal to the first axis X. In an alternative embodiment, not shown, the guide can have a straight development. Preferably the movement member 32 has a couple of first slots 33 specularly opposite (preferably obtained from, respectively, two opposite walls 34 of the member 32) and crossed by the pin 21 transversally (typically orthogonally) with respect to a respective main development plane (parallel to the lying plane of FIGS. 7-10) of the first slots 33. Preferably the movement member 32 is configured for moving the pin 21 along the main development line (49) (lying on said respective plane of main development) of the first slots while sliding along to the guide. The present invention contemplates also solutions, not shown, which envisage only one first guide or more than two first guides.

Preferably each first slot in the section on the respective main development plane is toothed along the respective main development line, being the section of each first slot composed by a discrete series (in the example eight) of seats 40 for the pin (with circular envelope), each seat being separated from its neighbouring seat(s) by at least a projection 48. In the example the projection is of cusp form, but it can have any form, particularly convex. For example, the first slots 33 have at least a portion of internal surface 47 (which can be the top surface or the bottom surface, or both or a portion of them) waved for creating the series of cusps 48 and seats 40. For example, the internal surface of the first slots opposite to the waved surface 47 is smooth for facilitating the movement of the pin 21. Preferably the opposite surface is elastically deformable (for example by a series of lightening cavities 46).

In the embodiment shown in figure, the main development line 49 of the first slots 33 is practically a circular arc. Such a shape is the result of the following design method. Given a desired value of the maximum excursion angle 59 of the elastic element between the configuration of the maximum and minimum stiffness (see below with reference to FIGS. 7 and 8, wherein it is exemplarily equal to 24°), this value is arbitrarily divided in a desired number of possible positions of the pin 21 (in the example this number is eight, evenly spaced). For each of these positions, the respective seat 40 is located on the movement member such that the component of the reaction force thrusting, during the oscillation, on the pin 21 tangentially to the internal surface of the slots of the structure (see below) has a direction which remains, when the first axis X is considered as a point of application of the force, inside the circle sector having as centre the centre of the pin 21 and delimitated by the two projections 48 of the seat 40 housing the pin 21. In this way the pin is thrusted by this component against the movement member 32, thrusting in turn the member against the guide 31 (contributing in blocking the member in its position), while avoiding that the pin 21 can overcome the projections and slid undesirably out of its seat 40. In this way, it is designed the overall shape of the first slots 33. From the foregoing, it can be understood that the specific shape of the first slots depends on multiple factors, such as the shape, disposition and dimensions of the various elements constituting the mechanism, the desired excursion of the response and of the adjustment actuation member, etc.

Preferably the movement system comprises a guide body 35 onto which the guide 31 is obtained, the guide body being rigidly connected to the structure 4, preferably at a top wall 36 of the structure.

Preferably the movement member 32 has an engagement portion 37 counter shaped to the guide 31. In the example shown, the guide 31 consists of two rails belonging to the guide body 35 and specularly opposite one another, and the engagement portion 37 consists of two opposite ribs belonging to the movement members, each one of the rib engaging the respective rail and having extension along said first circle arc.

Preferably at least one of the contact surfaces between the guide 31 and the movement member 32 (in the example shown the surface of the member 32) is toothed along the respective development direction, this toothing corresponding typically to the toothing of the first slots 33. For example, the guide body has a projection 38 corresponding to each rail, which engages a series (in the example eight) of seats 39 obtained on the movement member and corresponding to said seats 40 of the first slots.

Preferably the movement system 30 comprises an actuation lever 41 rotationally fixed to the structure 4 such as it can rotate about a second axis Y (preferably parallel to the first axis X) and connected to the movement member 32 by a junction having a third axis Z (preferably parallel to the first and second axes). Preferably the junction comprises a cylinder 42 rigidly connected to the movement member 32 (in the example the cylinder is integral with the member 32) and a second slot 43 obtained onto the actuation lever (having preferably radial extension with respect to the third axis Z). In an embodiment, not shown, the position of the slot and the cylinder can be inverted.

Preferably the movement system 30 comprises an actuation stem 44 rigidly connected to the actuation lever 41 and having extension along the second axis Y. It is observed that, in the shown example, advantageously the actuation stem and the actuation lever undergo a rotation of less than a quarter of turn (FIGS. 7 and 8) for switching from the configuration of minimum stiffness to the configuration of maximum stiffness.

Typically, the elastic element has a main development direction 50 coinciding with the direction of the reaction force. For example, the elastic element 12 has a first end 51 rotationally fixed to the support frame 2 for rotating about a fourth axis 52 (orthogonal to the direction 50 of the reaction force and parallel to the first, second and third axes) and a second end 53 longitudinally opposite to the first one and fastened (for example rotationally) to the pin 21 (likewise typically orthogonal to the direction 50 of the reaction force and parallel to the fourth axis 52).

In the embodiment shown, the frame has a bottom wall 54 and the elastic element 12 (more preferably the fourth axis 52) is located at the bottom wall.

The elastic element can comprise a spring 55, longitudinally interposed between its two ends 51 and 53.

Typically the spring 55 operates in traction. However, the present invention comprises any elastic element able to be elastically deformed and to exert an elastic reaction force, for example torsion, compression and flexion springs, elastomeric elements, pneumatic or fluid cylinders, etc.

In an embodiment, as exemplarily shown in the figures, the oscillation mechanism 1 can comprise a further elastic element 60 (typically comprising a respective spring) interposed between the support frame 2 and the structure 4 and configured for opposing a further reaction force to said oscillation of the structure 4 about the first axis X. Preferably the further elastic element 60 is structurally the same as the elastic element 12.

Preferably said further elastic element has a first end rotationally fixed to the support frame for rotating about a respective rotation axis (typically coincident with said fourth axis 52) and a second end longitudinally opposed to the first end and fastened (for example rotationally) to a further pin 61 (typically orthogonal to the further reaction force and parallel to the pin 21), the further pin 61 being coupled to the structure 4 in a fixed position, insofar for example it engages (for example through respective bushings) a couple of opposite holes 62 of the structure 4, such as the further reaction force is transferred to the structure with point of application corresponding with said further pin 61 and with direction and orientation unchanged.

Preferably at rest position the further elastic element 60 exerts a residual elastic force (for example it is slightly in traction), meanwhile said elastic element 12 has not any elastic energy (namely in other terms it is in the undeformed configuration and it does not exert any residual elastic force of recovery). In this way the structure is kept thrusted against said support frame (for example the surfaces 63 of the structure are thrusted against the surfaces 64 of the frame 2, with possible interposition of suitable protections for silencing the noises) by said residual elastic force, while said elastic element 12 is completely devoid of any force, so as it is possible an easy movement of the pin 21 in the rest position.

Preferably the adjustment system 20 has a couple of second slots 70 specularly opposite, for example obtained respectively onto two opposite walls 71 of said structure, and passed through by said pin 21 transversally (typically orthogonally) to a respective main development plane of the second slots (typically orthogonal to the fourth axis 52), said movement system being configured to move said pin 21 along a main development line 72 (lying on the respective development plane) of the second slots.

Preferably the main development line 72 of the second slots has a curvilinear development on the respective development plane, more preferably it has a development along a second circle arc having centre on said fourth axis 52 and radius equal to a distance between said pin 21 and said fourth axis at rest position (namely the radius is equal to the length of the elastic element at rest position, or when completely devoid of any force).

In use, when the mechanism is not subject to oscillation forces (FIG. 7), the structure is at rest position and it is preferably kept thrusted against the support frame 2 by the further elastic element 60, while preferably the elastic element 12 is completely unloaded.

Figure 9:
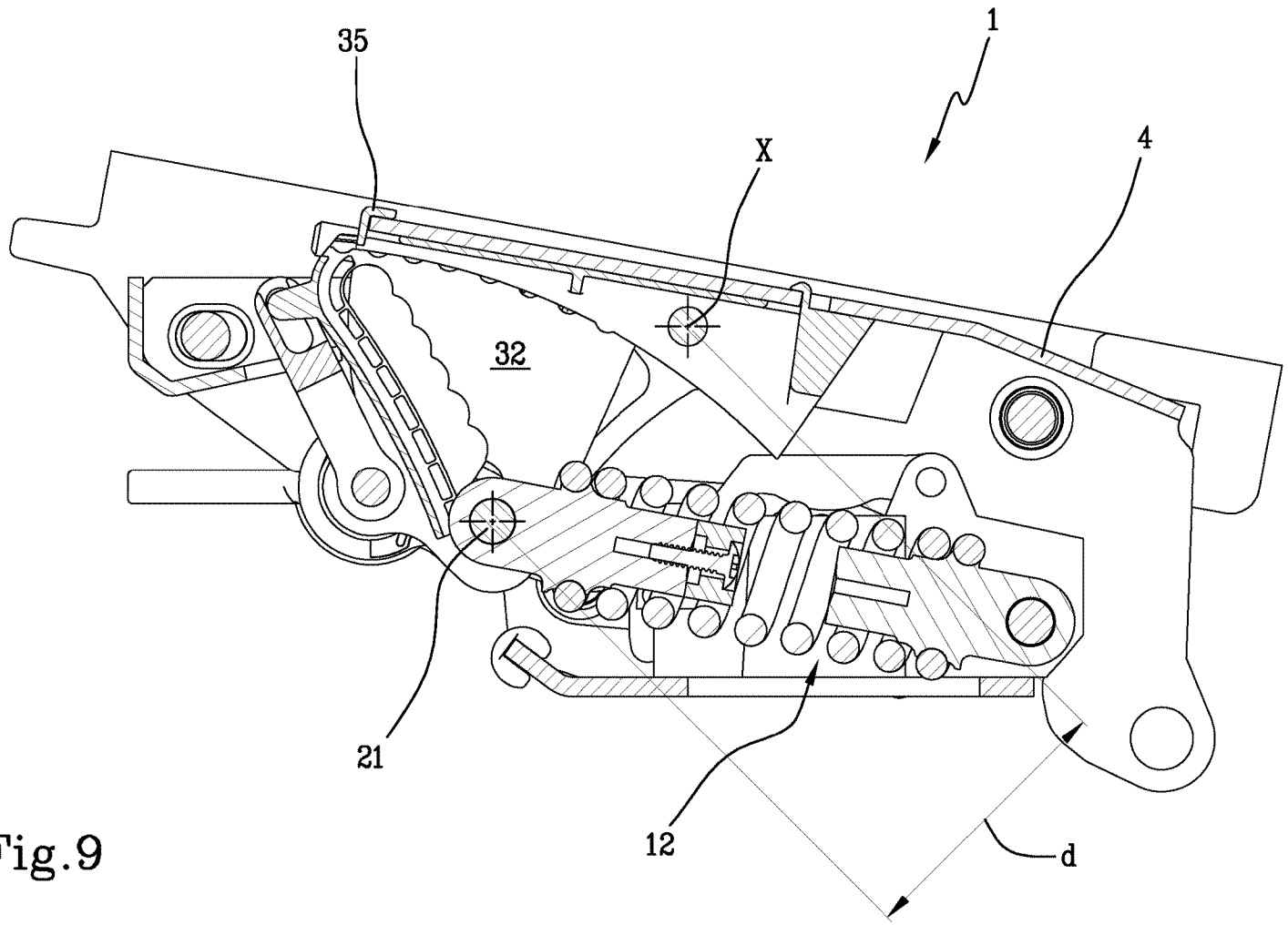
FIG. 9 is a section similar to that of FIG. 7, in the first configuration and in oscillation condition.

It is assumed that the mechanism is in a first configuration (shown in FIG. 7) in which the distanced between the point of application (coinciding with the pin 21) of the reaction force of the elastic element 12 to the structure 4 and the first axis X is maximum. In such configuration, the arm of the reaction force with respect to the first axis X is maximum, and the torque of the reaction force is maximum. Therefore, when the user exerts an oscillation force onto the structure 4, he receives a reaction torque relatively high, which he must match for oscillating the structure (e.g. the backrest) in a given desired oscillation, as shown in FIG. 9 (position of maximum allowed oscillation). So, the overall feeling is a 'stiff' response.

It is observed that the adjustment system 20 is integral with the structure 4 during the oscillation. For example, the pin 21 is kept blocked into the second slots 70 of the structure 4 because it is blocked in position by the movement member 32 as explained before. In particular, during the oscillation the reaction force acting on the pin can be decomposed into two components, one component directed along the radius of the second slots 70 (which is completely relieved onto the structure and which generates the mentioned torque of the reaction force acting onto the structure) and a component orthogonal to the first one (namely tangent to the second slots 70), which thrusts the pin towards and against said movement member. As explained before, this orthogonal component, when considered with point of application at the first axis X, remains inside the circular sector having centre on the first axis X and comprised between the two projections 48 of the seat 40 in which the pin is housed, so avoiding an undesired sliding of the pin along the first and the second slots.

Figure 8:
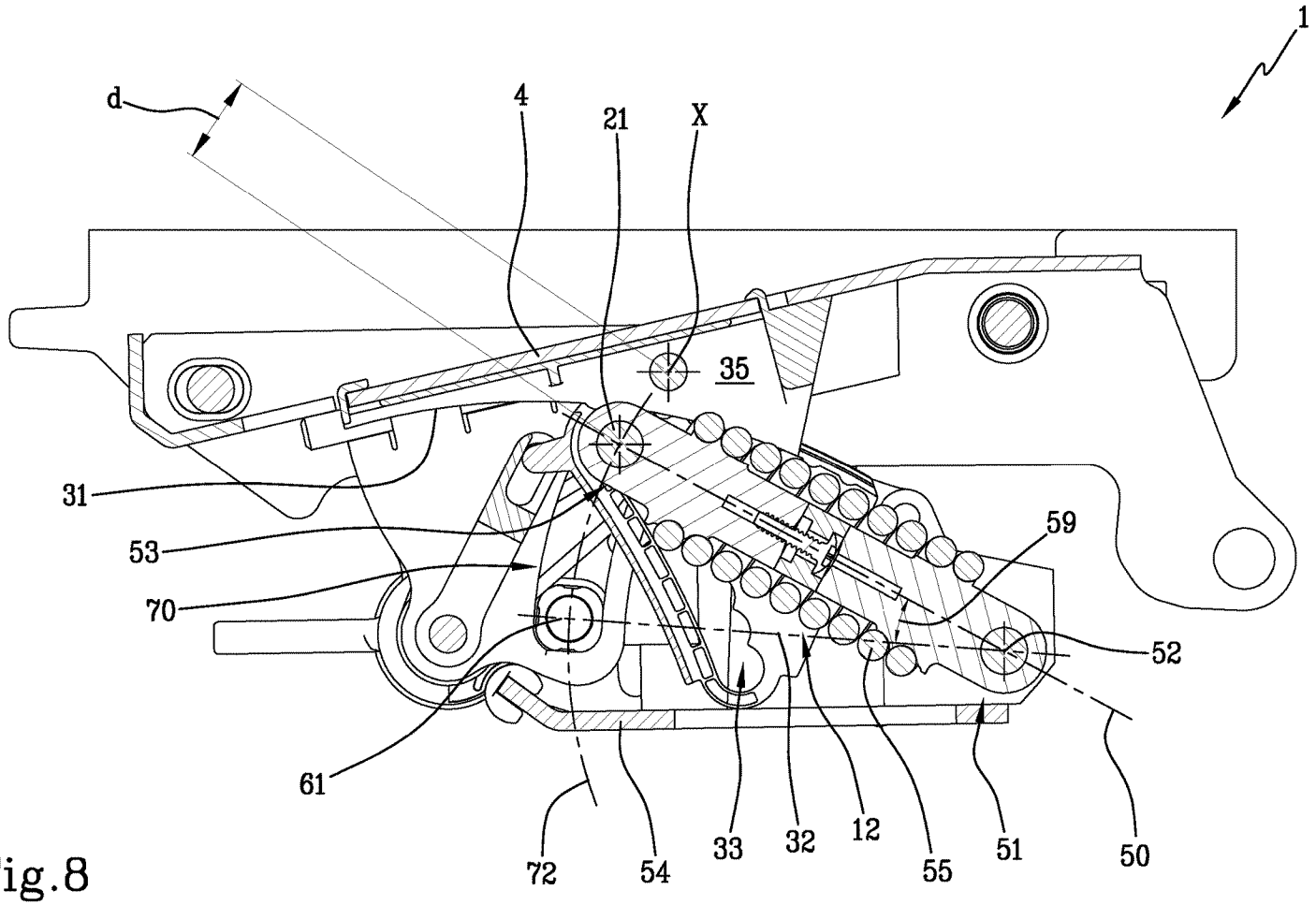
FIG. 8 is a section similar to that of FIG. 7, in a second configuration of the embodiment of FIG. 1 and at rest position.

When the user rotates the actuation stem 44 and so the actuation lever 41, he causes the sliding of the movement member 32 along the guide 31, so as the internal surfaces of the first slots 33 exert a thrust on the pin 21 forcing it to move (in a discrete way corresponding to the seats 39 and 40) along the first slots 33, so varying the distance d between the pin 21 and the first axis X, until to a second end configuration, shown in FIG. 8, in which the distanced is minimal (torque of the reaction force minimal).

Figure 10:
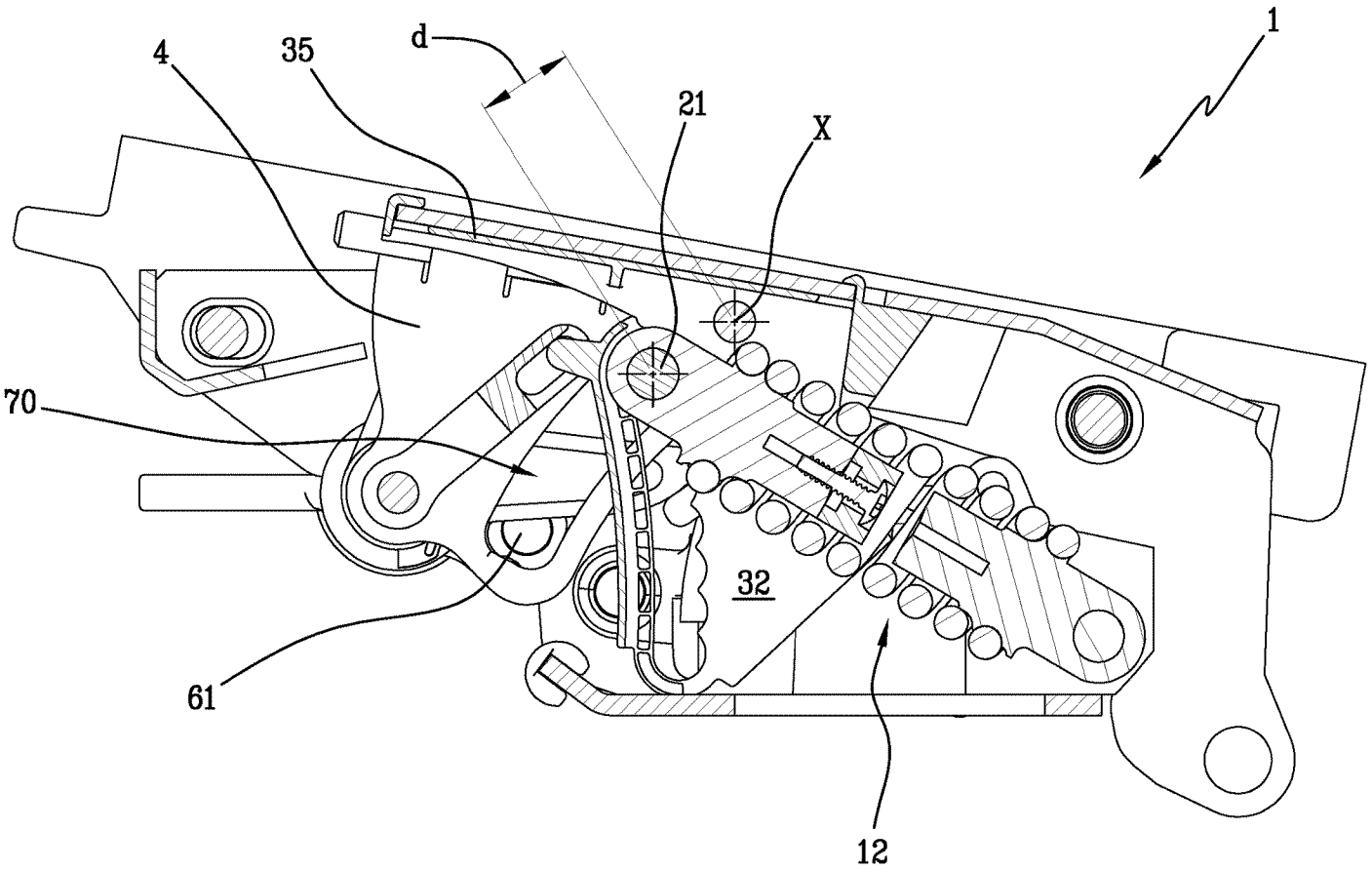
FIG. 10 is a section similar to that of FIG. 7, in the second configuration and in oscillation condition.

So, when the user exerts an oscillation force on the structure 4, he receives a reaction torque relatively low, which he has to match to oscillate the structure (e.g. the backrest) in mentioned desired oscillation, as shown in FIG. 10 (maximum allowed oscillation position). So, the overall feeling is a 'soft' response.

Moreover, it is observed that given an oscillation angle, the extension of the elastic element is bigger in the first configuration (maximum stiffness) than in the second configuration (minimum stiffness), as inferred from the comparison between FIGS. 9 and 10, so contributing to the adjustment of the response of the oscillation mechanism.

The invention claimed is:

1. Oscillation mechanism for chairs comprising:

a support frame suitable to be mounted on a stem of a chair, a structure pivotally coupled to said support frame to rotate about a first axis, an elastic element interposed between said support frame and said structure and configured to oppose a reaction force to an oscillation of said structure about said first axis from a rest position, in absence of oscillation forces, to an oscillation position, said reaction force generating a reaction moment acting on said structure with respect to the first axis; and an oscillation adjustment system configured to vary said reaction moment with said oscillation being unchanged, wherein the adjustment system comprises a pin movably coupled to said structure to vary a distance between the pin and the first axis, and wherein said elastic element is directly fastened to said pin so that said reaction force is transmitted to said structure with an application point corresponding to said pin and with direction and orientation unchanged wherein the adjustment system comprises a movement system of said pin for varying said distance between said pin and said first axis, said movement system comprising a guide integral with said structure and a movement member slidably engaged in said guide, wherein the movement member engages said pin so that when the movement member slides in said guide, the movement member moves said pin.

2. Oscillation mechanism according to claim 1, wherein no further elements are interposed between the elastic element and the pin, and wherein said reaction force transmitted to said structure is directed according to a main development direction of said elastic element.

3. Oscillation mechanism according to claim 1, wherein said movement member has a pair of first slots specularly opposed in a mirrored configuration and crossed by said pin crosswise to a respective plane of a main development of the first slots, said movement member being configured to move said pin along a respective main development line of the first slots in correspondence with the movement member in said guide, wherein said first slots are shaped and/or oriented in said respective main development plane, in such a way that inner surfaces of the first slots, when the movement member slides in the guide, exert a thrust on the pin forcing the pin to move along the first slots.

4. Oscillation mechanism according to claim 3, wherein a section of each first slot on said respective main development plane and/or at least one contact surface between said guide and said movement member is/are toothed along a respective main development line, and wherein said section of each first slot comprises a discrete series of seats for housing the pin, each seat being separated from a nearby one of the seats by a projection, wherein at least a portion of an inner surface of each first slot is elastically deformable, and wherein said first slots are shaped and/or oriented in said respective main development plane, in such a way that, during the oscillation, a component of said reaction force acting on the pin toward said movement member, when considered with the point of application in the first axis, remains within a sector of a circle having a center on the first axis and lies between the two projections of the seat in which the pin is housed, while avoiding undesired slippage of the pin.

5. Oscillation mechanism according to claim 1, wherein said movement system comprises a guide body in which said guide is formed, the guide body being rigidly connected to said structure in correspondence with an upper wall of said structure, wherein the movement member has an engagement portion counter-shaped to said guide and wherein the movement system comprises an actuation lever rotationally fixed to said structure to rotate around a second axis, integral with said structure, and connected to said movement member by a junction.

6. Oscillation mechanism according to claim 1, wherein said elastic element has a first end rotationally fixed to the support frame, in correspondence of a bottom wall of the support frame, to rotate around a fourth axis parallel to said first axis, and a second end longitudinally opposite the first end and fastened to said pin, wherein said elastic element comprises a spring interposed longitudinally between said first and second two ends, wherein, when the structure is in said rest position, said elastic element has no elastic energy, wherein the mechanism comprises a further elastic element interposed between said support frame and said structure and configured to oppose a further reaction force to said oscillation of said structure about said first axis and wherein, in the rest position, the further elastic element develops a residual elastic force, and said structure is maintained in abutment against said support frame by said residual elastic force.

7. Oscillation mechanism according to claim 1, wherein the adjustment system has a pair of second slots specularly opposite, obtained on said structure and crossed by said pin transversely to a respective main development plane of the second slots, said movement system being configured to move said pin along a main development line of the second slots, said main development line of the second slots having a curvilinear shape along a second arc of a circle having a center on said fourth axis in a plane orthogonal to said fourth axis, and a radius equal to a distance between said pin and said fourth axis in the rest position.

8. A chair comprising:

a floor prop, the oscillating mechanism according to claim 1, and a seat for a user and/or a backrest, wherein the floor prop comprises a stem and said support frame is rigidly mounted to said stem, and wherein said structure is integral with the seat and/or the backrest.

9. Oscillation mechanism according to claim 1, said guide has a curvilinear extension.

10. Oscillation mechanism according to claim 9, wherein said guide has an extension along a first arc of circle with a concavity directed towards said movement member and lying in a plane orthogonal to said first axis.

* * * * *